United States Patent [19]

Carswell et al.

[11] 4,302,343

[45] Nov. 24, 1981

[54] ROTARY SCREW COMPRESSOR LUBRICANTS

[75] Inventors: Robert Carswell; Philip W. McGraw, both of Lake Jackson, Tex.

[73] Assignee: The Dow Chemical Company, Midland, Mich.

[21] Appl. No.: 155,364

[22] Filed: Jun. 2, 1980

Related U.S. Application Data

[63] Continuation-in-part of Ser. No. 26,269, Apr. 2, 1979, abandoned.

[51] Int. Cl.[3] ..... C10M 1/40; C10M 3/34; C10M 5/22; C10M 7/38

[52] U.S. Cl. ..... 252/33.4; 252/51.5 R

[58] Field of Search ..... 252/51.5, 33.4

[56] References Cited

U.S. PATENT DOCUMENTS 4,072,619 2/1978 Williams et al. ..... 252/47.5

FOREIGN PATENT DOCUMENTS 933721 8/1963 United Kingdom .
986066 3/1965 United Kingdom .
1162818 8/1969 United Kingdom .

*Primary Examiner*—Helen M. S. Sneed

[57] ABSTRACT

Synthetic lubricants comprising 15 to 45 weight percent of an ester of a hindered polyhydric alcohol having 3 to 8 hydroxy groups and 5 to 10 carbon atoms with one or more alkanoic acids having 4 to 18 carbon atoms blended with 85 to 55 weight percent of one or more polyether polyol having an number average molecular weight from about 400 to 5000. The blends are compounded with antioxidants, corrosion inhibitors, and metal deactivators to produce a superior lubricant for rotary screw compressors that has a long life.

20 Claims, No Drawings

ROTARY SCREW COMPRESSOR LUBRICANTS

CROSS REFERENCE TO RELATED APPLICATION

This application is a continuation-in-part of Ser. No. 26,269, filed Apr. 2, 1979, now abandoned.

BACKGROUND OF THE INVENTION

This invention relates to synthetic lubricants which are a blend of alkanoic esters of hindered polyhydric alcohols having 3 to 8 hydroxyl groups and polyols or polyol ethers.

Rotary screw air compressors are well known in the art as can be seen from U.S. Pat. Nos. 2,622,707 (12-23-'52); 3,073,513 (1-15-'63); 3,073,514 (1-15-'63); and 3,129,877 (4-21-'64).

It is well known to use hydrocarbon lubricating oils to seal the rotors of the foregoing rotary screw air compressors, lubricate the bearings and cool the compressed gases. Due to the high temperature and pressure of the air, it has been found that these hydrocarbon oils break down and create a sludge in a relatively short time, i.e. about 1000 hours or less.

In attempts to lengthen the intervals between changing out the lubricants, resort has been made to the use of silicone fluids. These silicone fluids such as Sullair's 24-KT are very expensive and represent a considerable capital investment in that a new compressor unit with different bearings and seals is required. The use of carboxylic acid esters of polyols is known from U.S. Pat. No. 4,175,045 dated Nov. 20, 1979. Carboxylic acid esters of polyols are considered not sufficiently viscous at 210° F. to be effective in a rotary screw compressor.

It is known that synthetic esters made from dicarboxylic acids have been used to produce long lasting compressor fluids, such as Anderol 495 sold by Tenneco. The major component of Anderol is considered to be a dialkyl adipate. However, it is known that these synthetic esters are not hydrolytically stable. Anderol 500 (a dialkyl phthalate composition) is also known to be useful in reciprocating air compressors. However, this fluid is specifically recommended for reciprocating air compressors and is considered to be too viscous at low temperatures for use in rotary air compressors.

In U.S. Pat. No. 4,072,619 (dated Feb. 7, 1978) polyester-alkylene glycol compositions are disclosed wherein phenothiazine is incorporated into the alkylene glycols. However, these compositions have been found to degrade in a relatively short time i.e. 1000 hours.

Synthetic lubricants comprising a major amount of a polyester and a minor amount of a monocapped polyglycol are known from British Pat. Nos. 933,721; 986,066; and 1,162,818, however these compositions are disclosed to be only useful in aircraft gas turbines where gross contamination with water is not a problem.

SUMMARY OF THE INVENTION

It now has been found that a suitably inhibited blend of hindered alkanoic esters of aliphatic polyhydric alcohols having 3 to 8 hydroxyl groups and 5 to 10 carbon atoms with polyether polyols have the required high temperature viscosity and stability to heat, air, and water.

More specifically, the synthetic base lubricants of this invention comprise a lubricant composition comprising, (A) about 15 to 45 weight percent of an ester of a hindered polyhydric alcohol having 3 to 8 hydroxyl groups with one or more alkanoic acids having 4 to 18 carbon atoms, and (B) about 85 to 55 weight percent of one or more polyether polyol compounds which have a flash point greater than 375° F. and which have the formula

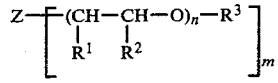

where

Z is the residue of a non-amine initiator compound having 1–8 active hydrogens, $R^1$ is hydrogen or methyl when $R^2$ is methyl, $R^2$ is hydrogen, methyl, or ethyl when $R^1$ is hydrogen, n is a number having an average value which will give a molecular weight range from about 400 to about 5000, m is an integer having a value of from 1 to about 8, $R^3$ is hydrogen or an alkyl group of 1 to 6 carbon atoms.

An additional aspect of the present invention comprises the above base lubricant with the addition of effective amounts of oxidation inhibitors, corrosion inhibitors, and metal or copper deactivators.

While the lubricants of this invention are useful in rotary screw, sliding vane, and reciprocating piston compressors, they are also useful in other mechanical devices where hydrolytic stability is desired or necessary such as outboard motors or marine engines in general.

The combination or blend of the foregoing polyether polyols and esters with and without additives can also find utility in industry for other lubricating applications, such as mold release agents, lubricants for glass making machinery, gears, gasoline or diesel engines, textile machinery, fiber lubricants, metal working fluids, and the like.

DETAILED DESCRIPTION OF THE INVENTION

The neutral esters used in this invention are commercially available. Examples of suitable hindered esters are:

esters of trimethylol ethane with alkanoic acids of 4–18 carbon atoms, esters of trimethylol propane with alkanoic acids of 4–18 carbons, esters of trimethylol butane with alkanoic acids of 4–18 carbon atoms, esters of pentaerythritol, dipentaerythritol, or tripentaerythritol with alkanoic acids of 4–18 carbon atoms, Specific examples of these esters are trimethylolethane tricaproate, trimethylolpropane trivalerate, trimethylolpropane tri n-heptanoate, trimethylolpropane tripelargonate, trimethylolpropane tricaprate, pentaerthritol tetracaproate, dipentaerythritol hexabutyrate, pentaerythritol tetrastearate and the related esters with mixed acid moieties. Other examples of these esters and their preparation are shown in U.S. Pat. No. 4,175,045 dated Nov. 20, 1979.

Examples of the polyether polyols or polyoxyalkylene polyols used in this invention are those derived from ethylene oxide, propylene oxide, 1-2, or 2-3 butylene oxide. The above oxides may be polymerized alone, i.e., homopolymerized or in combination. The combined oxides may also be combined in a random or block addition. While some of the above compounds may be of a hydrophyllic nature, those of a hydrophobic nature are preferred, such as those derived from propylene oxide, butylene oxides or combinations thereof.

Examples of suitable capped polyoxyalkylene glycols are those derived from ethylene, propylene, and butylene oxides wherein the alkylene oxides are initiated from a compound having 1 to 8 active hydrogens in a known manner. The terminal hydroxyl groups may be further reacted with organic acids to form esters or with alkyl or aryl halides to form alkyl or aryl capped polyoxyalkylene glycols. These polyether polyols and their preparation are well known from the book "Polyurethanes" by Saunders and Frisch, Interscience Publishers (1962), pages 33-39. This book is incorporated by reference herein.

Examples of suitable initiator compounds which are employed to prepare the above polyether polyols are compounds having 1-8 active hydrogens such as for example water, methanol, ethanol, propanol, butanol, ethylene glycol, propylene glycol, butylene glycol, 1,6-hexane diol, glycerine, trimethylolpropane, pentaerythritol, sorbitol, sucrose, mixtures thereof and the like.

Other initiator compounds which are useful include monohydric phenols and dihydric phenols and their alkylated derivatives such as phenol, o, m, and p cresol, guaiacol, saligenin, carvacrol, thymol, o and p-hydroxy diphenyl, catechol, resorcinol, hydroquinone, pyrogallol, and phloroglucinol.

The foregoing polyether polyols should have a flash point greater that 375° F. and preferably greater than 450° F. They also should have a number average molecular weight range from about 400 to 5000 and preferably in the range 700 to 2500.

The foregoing polyether polyols are blended to give a base lubricant composition containing 15 to 45 weight percent of the esters and 85 to 55 weight percent of the polyols with the ranges 22 to 35 and 78 to 65 being the preferred ranges, respectively.

The compositions of this invention when used in a rotary screw air compressor are selected so as to have a viscosity in the range of 5 to 25 centistokes at 210° F. and preferably 6 to 16 centistokes at 210° F. and a pour point in the range of 0° to −65° F.

The final lubricant compositions of this invention may contain effective amounts of additives, such as antioxidants, corrosion inhibitors, metal deactivators, lubricity additives, extreme pressure additives, dispersants, detergents, or such additives as may be required.

Examples of useful antioxidants which can be used herein are phenyl naphthylamines, i.e., both alpha and beta-naphthyl amines; diphenyl amine; iminodibenzyl; p,p'-dioctyl-diphenylamine; and related aromatic amines. Other suitable antioxidants are hindered phenolics such as 6-t-butylphenol, 2,6-di-t-butylphenol and 4-methyl-2,6-di-t-butylphenol and the like.

Examples of suitable ferrous metal corrosion inhibitors are the metal sulfonates such as calcium petroleum sulfonate, barium dinonylnaphthalene sulfonate and basic barium dinonylnaphthalene sulfonate, carbonated or non-carbonated.

Examples of suitable cuprous metal deactivators are imidazole, benzimidazole, pyrazole, benzotriazole, tolutriazole, 2-methyl benzimidazole, 3,5-dimethyl pyrazole, and methylene bis-benzotriazole.

An effective amount of the foregoing additives for use in a rotary screw air compressor is generally in the range from 0.1 to 5.0% by weight for the antioxidants, 0.1 to 5.0% by weight for the corrosion inhibitors, and 0.001 to 0.5 percent by weight for the metal deactivators. The foregoing weight percentages are based on the total weight of the polyether polyols and the esters. It is to be understood that more or less of the additives may be used depending upon the circumstances for which the final compositions is to be used.

The following examples are presented to illustrate but not limit the invention.

EXAMPLE 1

The following composition was prepared.

175 pounds polypropylene glycol (number average molecular weight 1200)
75 pounds Stauffer ester No. 825*
3.75 pounds p,p'dioctyl diphenylamine
1.25 pound NA-SUL 611**
0.125 pound benzotriazole

*a pentaerythritol tetraester with alkanoic acids sold by the Stauffer Chemical Company.
**a basic barium dinonylnaphthalene sulfonate in mineral oil sold by the R. T. Vanderbilt Company.

The polyglycol and the ester were weighed into a 30 gallon stainless steel mixing vessel, equipped with a paddle stirrer and a controllable electric heating element. The temperature was raised to 45°-55° C. with stirring. The additives were then weighted in, in the order given above.

The above 25 gallon mixture was allowed to stir with the heating maintained at 45°-55° C. until a clear solution was obtained. A clear light brown solution was obtained and was drained from the mixing vessel by opening a valve situated in the base of the vessel. The blend was collected into 5 gallon containers. The fluid was retained for testing as described in the following manner. This example illustrates the preparation of a blend of 70 weight percent polyglycol and 30 weight percent of a polyester.

50 grams of fluid prepared above was sealed in a rotary bomb and tested for oxidation resistance in accordance with ASTM D-2272. The fluid gave 18.5 hours in the oxidation test which is the time required to reach a 25 pound pressure drop.

It is to be noted in this example and the following examples that the number of hours in the oxidation test can vary about two hours over and under the given numbers because the test procedure is not exactly reproducable.

300 ml of the above fluid was tested for corrosion resistance in accordance with ASTM D-665 (procedure A). The fluid passed the test.

Fourteen gallons of the above fluid was placed in a 250 cubic feet per minute rotary screw air compressor and the compressor was run for 9700 continuous hours with periodic shutdowns at 1000 hour intervals to take a 4 ounce sample for analysis. Four ounces of new fluid replaced the withdrawn sample. The test was terminated at 9700 hours. Upon examination the fluid withdrawn from the compressor was found to be in excellent condition.

EXAMPLE 2

Following the procedures set forth in Example 1, a blend of 76% of the polypropylene glycol and 24% of trimethylolpropane tripelargonate was prepared with the same percentages of the additives. This formulation when tested by the above oxidation test gave 16 hours and 50 minutes and passed the corrosion test.

EXAMPLE 3

Following the procedures set forth in Example 1 with the same additives, a blend of 80% of the polypropylene glycol and 20% of Stauffer ester 704 (a trimethylol propane fatty acid ester) was prepared. This formulation gave 15 hours and 10 minutes in the above oxidation test and passed the corrosion test.

CONTROLS 1-3

Following the oxidation test of Example 1, a hydrocarbon lubricant sold by Mobil Oil Company under the tradename Delvac 1110, a petroleum oil sold by Exxon under the tradename Estor D 3-10, and Tenneco's Anderol 495 (a fully formulated synthetic fluid based on a dicarboxylic acid ester) were tested. The above hydrocarbon lubricants have been recommended for use in rotary screw compressors by lubrication engineers as has the Anderol 495. The results of the controls and examples are shown in Table I.

TABLE I

| Test Run | Time Req'd for 25 lb. Press. Drop |
|---|---|
| Control 1 (Delvac 1110) | 2 hours 12 minutes |
| Control 2 (Estor D 3-10) | 1 hour 5 minutes |
| Control 3 (Anderol 495) | 9 hours 50 minutes |
| Example 1 | 18 hours 30 minutes |
| Example 2 | 16 hours 50 minutes |
| Example 3 | 15 hours 10 minutes |

From the foregoing, it is indicated that lubricating oils have a relatively short life span and that while dicarboxylic acid esters are better than lubricating oils they are less effective than the compositions of this invention. Furthermore, the compositions containing trimethyolpropane esters of Example 2 are vastly improved over the known esters of Control 3. Likewise, the compositions containing esters of Example 1 are even more improved over Example 2 and Control 3.

EXAMPLES 4-7

In each of these examples, 70 grams of the following glycols were blended with 30 grams of Herculube J (a pentaerythritol tetraester with alkanoic acids sold by Hercules, Inc.). For each 100 grams sampe of the blend was added 1.5 grams p,p'-dioctyl diphenylamine
0.5 grams Na Sul 611, and
0.05 grams tolyltriazole.

Fifty grams of the formulation was then tested in a rotary bomb test as set forth in Example 1. Similar control runs were made with closely related glycols. The results are set forth in Table II.

TABLE II

| Run | Time Req'd for 25 25 lb. Pressure Drop |
|---|---|
| Example 4 (Glycerine initiated polyethylene glycol having a mol. wt. of about 2500) | 18 hrs., 0 min. |
| Example 5 (butyl alcohol initiated poly propylene glycol having a mol. wt. of about 2000) | 15 hrs., 30 min. |
| Example 6 (tridecyl alcohol initiated poly ethylene glycol having a mol. wt. of about 600) | 16 hrs., 0 min. |
| Example 7 (polybutylene glycol having a mol. wt. of about 2000) | 15 hrs., 30 min. |
| Control 4 (diphenylamine initiated poly-propylene glycol having a mol. wt. of about 2000) | 7 hrs., 30 min. |
| Control 5 (aniline initiated polybutylene glycol having a mol. wt. of about 2000) | 5 hrs., 40 min. |
| Control 6 (ethylene diamine initiated random copolymer of ethylene oxide and propylene oxide mol. wt. of about 2000) | 0 hrs., 10 min. |

Table II shows that, in general, the amine initiated polyglycols do not survive under the severe test conditions set forth in ASTM D-2272.

We claim:

1. A lubricant composition comprising,
(A) about 15 to 45 weight percent of an ester of a hindered polyhydric alcohol having 3 to 8 hydroxyl groups with one or more alkanoic acids having 4 to 18 carbon atoms, and
(B) about 85 to 55 weight percent of one or more polyether polyol compounds which have a flash point greater than 375° F. and which have the formula $$Z\left[(\underset{R^1}{\underset{|}{CH}}-\underset{R^2}{\underset{|}{CH}}-O)_n-R^3\right]_m$$

where
Z is the residue of a non-amine initiator compound having 1-8 active hydrogens,
$R^1$ is hydrogen or methyl when $R^2$ is methyl,
$R^2$ is hydrogen, methyl, or ethyl when $R^1$ is hydrogen,
n is a number having an average value which will give a molecular weight range from about 400 to about 5000,
m is an integer having a value of from 1 to about 8,
$R^3$ is hydrogen or an alkyl group of 1 to 6 carbon atoms.

2. The lubricant composition of claim 1 wherein the weight percent of the ester ranges from 22 to 35 and the weight percent of said compound ranges from 78 to 65.

3. A lubricant composition comprising,
(A) about 15 to 45 weight percent of an ester of a hindered polyhydric alcohol having 3 to 8 hydroxyl groups with one or more alkanoic acids having 4 to 18 carbon atoms, and
(B) about 85 to 55 weight percent of one or more polyoxyalkylene glycols having a flash point greater than 375° F. and having a number average molecular weight range from about 400 to 5000 and mixtures thereof.

4. The lubricant composition of claim 3 wherein said polyoxyalkylene glycols are homopolymers.

5. The lubricant composition of claim 3 wherein said polyoxyalkylene glycols are random copolymers.

6. The lubricant composition of claim 3 wherein said polyoxyalkylene glycols are block copolymers.

7. A lubricant composition comprising, (A) about 15 to 45 weight percent of an ester of pentaerythritol with one or more alkanoic acids having 4 to 18 carbon atoms, and (B) about 85 to 55 weight percent of one or more polyoxyalkylene glycols having a flash point greater than 375° F. and having a number average molecular weight range from about 700 to 2500 and mixtures thereof.

8. The lubricant composition of claim 7 wherein the weight percent of the ester ranges from 22 to 35 and the weight percent of the polyglycol ranges from 78 to 65.

9. The lubricant composition of claim 8 wherein the glycol is polypropylene glycol having a number average molecular weight of 1200.

10. The lubricant composition of claim 9 which comprises 30 weight percent of said ester and 70 weight percent of said polypropylene glycol.

11. The composition of claim 1 which contains in addition (A) an effective amount of an antioxidant, (B) an effective amount of a ferrous metal corrosion inhibitor, and (C) an effective amount of a cuprous deactivator.

12. The composition of claim 1 which contains in addition (A) about 0.1 to 5.0 weight percent of an aromatic amine antioxidant, (B) about 0.1 to 5.0 weight percent of a ferrous metal corrosion inhibitor, and (C) about 0.001 to 0.5 weight percent of a cuprous metal deactivator.

13. A method of lubricating a rotary screw air compressor wherein said compressor is continuously run for long time intervals without changing out the lubricant which comprises using as the lubricant the composition of claim 11.

14. A method of lubricating a rotary screw air compressor wherein said compressor is continuously run for long time intervals without changing out the lubricant which comprises using as the lubricant the composition of claim 12.

15. The composition of claim 1 which contains in addition (A) about 0.1 to 5.0 weight percent of p,p'-dioctyl diphenylamine, (B) about 0.1 to 5.0 weight percent of basic barium dinonylnaphthalene sulfonate, and (C) about 0.001 to 0.5 weight percent of tolyltriazole.

16. The composition of claim 3 which contains in addition (A) about 0.1 to 5.0 weight percent of p,p'-dioctyl diphenylamine, (B) about 0.1 to 5.0 weight percent of basic barium dinonylnaphthalene sulfonate, and (C) about 0.001 to 0.5 weight percent of tolyltriazole.

17. The composition of claim 7 which contains in addition (A) about 0.1 to 5.0 weight percent of p,p'-dioctyl diphenylamine, (B) about 0.1 to 5.0 weight percent of basic barium dinonylnaphthalene sulfonate, and (C) about 0.001 to 0.5 weight percent of tolyltriazole.

18. A method of lubricating a rotary screw air compressor wherein said compressor is continuously run for long time intervals without changing out the lubricant which comprises using as the lubricant the composition of claim 15.

19. A method of lubricating a rotary screw air compressor wherein said compressor is continuously run for long time intervals without changing out the lubricant which comprises using as the lubricant the composition of claim 16.

20. A method of lubricating a rotary screw air compressor wherein said compressor is continuously run for long time intervals without changing out the lubricant which comprises using as the lubricant the composition of claim 17.

* * * * *